United States Patent [19]

Shaw

[11] 4,115,603

[45] Sep. 19, 1978

[54] PROCESS FOR PRODUCING LITHOGRAPHIC PRINTING PLATES HAVING A PAPER BASE

[75] Inventor: Michael J. Shaw, Kalamazoo, Mich.

[73] Assignee: Allied Paper Incorporated, Kalamazoo, Mich.

[21] Appl. No.: 823,844

[22] Filed: Aug. 11, 1977

Related U.S. Application Data

[63] Continuation-in-part of Ser. No. 653,469, Jan. 29, 1976, abandoned.

[51] Int. Cl.[2] ..... B41C 1/10

[52] U.S. Cl. ..... 427/326; 101/460; 101/462; 162/135; 162/136; 162/137; 162/205; 427/391; 428/446; 428/454

[58] Field of Search ..... 101/460, 462; 162/205, 162/135, 136, 137; 427/372 A, 326, 391; 428/446, 454

[56] References Cited

U.S. PATENT DOCUMENTS

| | | | |
|---|---|---|---|
| 3,017,295 | 1/1962 | Outterson et al. | 162/135 X |
| 3,181,460 | 5/1965 | Perkins et al. | 101/462 X |
| 3,592,730 | 7/1971 | Newman | 162/137 |
| 3,846,354 | 11/1974 | Fallwell | 260/17.4 ST |
| 3,925,328 | 12/1975 | Shibahara et al | 260/17.4 X |

FOREIGN PATENT DOCUMENTS

| | | | |
|---|---|---|---|
| 873,682 | 7/1961 | United Kingdom | 162/135 |

*Primary Examiner*—Michael R. Lusignan
*Attorney, Agent, or Firm*—Richard H. Thomas

[57] ABSTRACT

In a process for the manufacture of a lithographic printing plate having a paper base and a lithographic printing surface thereon comprising a resinous coating, lower coat weights leading to high coating speeds can be obtained by first smoothing the base to not substantially greater than about 150 Sheffield units, then size-pressing onto the smooth base either a barrier coat for the lithographic printing surface or a single coat comprising said lithographic printing surface.

6 Claims, No Drawings

PROCESS FOR PRODUCING LITHOGRAPHIC PRINTING PLATES HAVING A PAPER BASE

This application is a continuation-in-part of prior copending application Ser. No. 653,469, filed Jan. 29, 1976, now abandoned, assigned to assignee of the present application.

This invention relates to an improvement in a process for making lithographic printing plates having a paper base, and more particularly to such process using a size press or the like for applying one or more resinous coats on the base by which lower coat weights can be obtained permitting running at higher speeds.

BACKGROUND OF THE INVENTION

Lithographic printing plates are discussed in U.S. patent application Ser. No. 493,528, filed Aug. 1, 1974, and entitled "Lithographic Printing Plate and Process for Making Same"*; application U.S. Ser. No. 634,899, on "Improved Lithographic Printing Plate" (Assignee's docket AP 37-B), filed on Nov. 24, 1975; and application U.S. Ser. No. 634,900, on "Improved Lithographic Printing Plate" (Assignee's docket AP 37-C), also filed on Nov. 24, 1975. The teachings of these patent applications are incorporated herein expressly by reference.

*Now U.S. Pat. No. 3,922,441

Paper base lithographic printing plates and methods for making the same have been well known for a considerable period of time. Lithography depends upon the immiscibility of a greasy lithographic printing ink and an aqueous etch or lithographic solution. In use, a paper lithographic printing plate is first imaged in a known manner with typed, written, or drawn copy material to be reproduced. The image may also be obtained in other ways, for instance, by xerography; e.g. Electrofax (trademark, Radio Corp. of America) and Xerox (trademark, Xerox Corp.). The grease-receptive imaging material employed makes the imaged areas ink receptive and water repellent (i.e. hydrophobic). The remaining non-imaged surface is water receptive and ink repellent (i.e. hydrophilic).

The imaged plate is placed on a plate cylinder of an offset duplicating press. The overall surface of the plate then is treated with an aqueous wet-out liquid which wets all portions of the plate except those areas that have been imaged and are water repellent. The press inking roll then passes over the surface of the plate and deposits a film of ink only upon the ink-receptive imaged areas. In the printing operation, the ink from the imaged areas is transferred in reverse to a rubber offset blanket which in turn prints directly onto a paper sheet so as to form a copy.

Desirable attributes of a lithographic or planographic printing plate include the producing of clean copy, good toning, good imaging, stop-go properties, lack of curling or wrinkling of plates while on a press, and, while accepting ink and etch, also being sufficiently water resistant so that the plate will not "milk" or "pick". The instant process produced direct image masters having the above desirable attributes, and it produces them in a rapid, efficient, and economical manner.

Conventionally, the process of making lithographic printing plates having a paper base has involved conventional sheet forming and drying of the paper on a fourdrinier paper machine and then applying to the paper base whatever coatings are desired, either in an on-machine coater or off-machine coater, typical coaters being a blade coater, an "air doctor" coater, a roll coater or the like. The fourdrinier machine itself may comprise conventionally, after the suction boxes, a press to mechanically remove water from the paper sheet followed by further water removal in an evaporative drying section, such as a series of steam heated drying cylinders. This first dryer section may then be followed by a size press, by which starch sizing is added to the paper, and a second evaporative dryer section to remove water added to the paper in the size press. The coaters then would follow the second dryer section. The primary problem with such conventional lithographic printing plate manufacture is that the paper base following drying has a relatively rough surface requiring the application of relatively thick coatings, either a barrier coat or both barrier and face coats, to achieve a satisfactory plate. The thickness of the coating requires correspondingly more intensive drying in turn limiting the speed with which the fourdrinier machine can be run, particularly if the coater is an on-machine coater.

SUMMARY OF THE INVENTION

By the present invention, the lithographic printing surface, i.e. face coat and/or barrier coat, if employed, are applied at the fourdrinier machine size press rather than an on or off-machine coating press.

In particular, the present invention relates, in a process for the manufacture of a lithographic printing plate having a paper base and a lithographic printing surface thereon comprising a resinous coating, to the improvement which comprises smoothing said paper base, following drying in a fourdrinier machine, to not substantially greater than about 150 Sheffield units, and size-pressing onto the resulting smooth base either a barrier coat for said lithographic printing surface and/or a single coat comprising said lithographic printing surface.

DETAILED DESCRIPTION OF THE INVENTION

Paper, such as high wet strength paper issuing from the first dryer section of a fourdrinier paper machine is smoothed using a conventional breaker stack or like rolling mechanism to achieve a smoothness of not substantially greater than about 150 Sheffield units, preferably less than about 120 Sheffield units, and then while still at high speed of at least about 350 feet per minute, but as high as 3,000 feet per minute, the resinous coating is applied to the paper base sheet by a conventional size press. The coated product is then dried and finished.

Typical such resinous coatings are disclosed in prior U.S. Pat. No. 3,922,441; copending application Ser. No. 634,899, Assignee's docket AP-37-B; or copending application Ser. No. 634,900, Assignee's docket AP-37-C. By the present invention, the paper base sheet following application of the resinous coating in the size press and drying is ready for subdivision into appropriate size direct image masters without further processing.

In some instances, a pigmented or unpigmented barrier coat is applied to the paper base sheet prior to application of the face coat, particularly for medium or long-run plates. In accordance with the concepts of the present invention, this barrier coat preferably is applied at the fourdrinier size press, and the face coat can then be applied either in a following size press or with a coater such as an air knife coater, a rod coater or a blade coater.

By the present invention, by smoothing the paper stock to not substantially greater than about 150 Sheffield units or less barrier coats can be applied, for instance in obtaining a medium-to-long run plate (1,000–5,000 copies), to the paper stock at rates of about 4 to about 7 pounds per ream (3,300 square feet) as compared to 7-15 pounds per ream normally required for lithographic printing plates prepared according to prior art processes. Similarly, if only a face coat is applied to the paper stock, for shortrun plates (e.g., about 500 copies), the coating according to the concepts of the present invention is applied at the rate of about 2 to about 4 pounds per ream, as compared to about 5 to about 10 pounds per ream by conventional processes.

Machine speeds are correspondingly increased, substantially proportional to the reduction in coating weight.

EXAMPLE

A medium-to-long run plate (1,000–5,000 copies) is prepared on a fourdrinier machine by first smoothing the paper base stock, following initial drying in a first evaporative drying section, to about 120 Sheffield units. The smoothing is carried out in a conventional on-the-machine breaker stack. The paper stock is then passed through a conventional size press in which a barrier coat is applied in equal amounts to both sides at the rate of about 6 pounds per ream (3,300 square feet).

The barrier coating is a typical clay protein barrier coat prepared to about 46% solids and containing the following ingredients:

| | |
|---|---|
| H T Clay | 66.4% |
| Dispex N40 Dispersant (trademark, Allied Colloids Inc.) | 0.2% |
| Casein | 6.8% |
| Borax | 0.6% |
| Styrene Butadiene Latex | 24.4% |
| Formaldehyde | 1.6% |
| Sufficient ammonia to bring the pH to 9.0 | |

The paper is then coated with a number 10 Meyer Rod with a solution comprising a mixture of Ludox 130M (a positively charged or cationic silica, trademark E. I. duPont de Nemours and Co.) and polyvinyl alcohol (99% hydrolyzed Elvanol 7130) in a ratio of 4/1 parts, respectively. The paper is then dried at about 100° C., and gives after calendering without further processing, except subdivision into appropriate sizes, direct image masters for 1,000 to 5,000 copies.

By comparison, a similar such plate prepared employing conventional techniques, without smoothing, may have a roughness of about Sheffield 320 following initial drying. Using off-machine or on-machine coating, following drying requires a barrier coat of as mush as 7-15 pounds per ream and up to 20 pounds per ream. Smoothing to about Sheffield 160, or less, thus constitutes about a 30-50% improvement in smoothness, permitting application of about 50-70% of the normal coat weight. The lower coat weight in turn permits higher fourdrinier machine speeds, in that the lower coat weight requires less drying time. At the same time no loss in properties of the lithographic masters is experienced.

I claim:

1. In a process for the manufacture of a lithographic printing plate having a paper base and a lithographic printing surface thereon comprising a resinous coating, said process being carried out on a fourdrinier paper machine and including the steps of forming said base and subjecting the base to initial drying, the improvemet for reducing coat weight and achieving increased fourdrinier machine speeds of at least about 350 feet per minute which comprises smoothing said base to not substantially greater than about 150 Sheffield units following said initial drying; and size-press coating onto the resulting smoothed base either a barrier coat for said lithographic printing surface or a single coat comprising said lithographic printing surface, at the rate of about 2 to about 7 pounds per ream.

2. The process of claim 1 wherein a barrier coat for said lithographic printing surface is applied by size-press coating after smoothing.

3. The process of claim 2 wherein said lithographic surface is applied over said barrier coat.

4. The process of claim 1 wherein a single coat comprising said lithographic surface is applied by size-press coating after smoothing.

5. The process of claim 1 wherein the base is smoothed to about 120 Sheffield units.

6. The process of claim 1 wherein the smoothing is carried out in a dryer breaker stack.

* * * * *